US005611758A

United States Patent [19]

Rodgers, Jr.

[11] Patent Number: 5,611,758

[45] Date of Patent: Mar. 18, 1997

[54] RECUMBENT EXERCISE APPARATUS

[75] Inventor: Robert E. Rodgers, Jr., Houston, Tex.

[73] Assignee: CCS, LLC, Denver, Colo.

[21] Appl. No.: 648,434

[22] Filed: May 15, 1996

[51] Int. Cl.[6] ..... A63B 22/00

[52] U.S. Cl. ..... 482/57; 482/51; 482/72

[58] Field of Search ..... 482/51, 52, 53, 482/54, 57, 70, 62, 71, 74, 79, 80, 92, 72

[56] References Cited

U.S. PATENT DOCUMENTS

| | | | |
|---|---|---|---|
| 219,439 | 9/1879 | Blend . | |
| 2,603,486 | 7/1952 | Hughes . | |
| 3,316,898 | 5/1967 | Brown . | |
| 3,432,164 | 3/1969 | Deeks . | |
| 3,759,511 | 9/1973 | Zinkin et al. . | |
| 4,053,173 | 10/1977 | Chase, Sr. . | |
| 4,188,030 | 2/1980 | Hooper . | |
| 4,379,566 | 4/1983 | Titcomb . | |
| 4,456,276 | 6/1984 | Bortolin . | |
| 4,509,742 | 4/1985 | Cones . | |
| 4,555,109 | 11/1985 | Hartmann . | |
| 4,561,318 | 12/1985 | Schirrmacher . | |
| 4,645,200 | 2/1987 | Hix . | |
| 4,679,786 | 7/1987 | Rodgers . | |
| 4,684,126 | 8/1987 | Dalebout et al. | 482/72 |
| 4,720,093 | 1/1988 | Del Mar . | |
| 4,869,494 | 9/1989 | Lambert, Sr. . | |
| 4,900,013 | 2/1990 | Rodgers, Jr. . | |
| 4,949,954 | 8/1990 | Hix . | |
| 4,949,993 | 8/1990 | Stark et al. . | |
| 4,989,857 | 2/1991 | Kuo . | |
| 5,039,087 | 8/1991 | Kuo . | |
| 5,039,088 | 8/1991 | Shifferaw . | |
| 5,131,895 | 7/1992 | Rogers, Jr. . | |
| 5,135,447 | 8/1992 | Robards, Jr. et al. . | |
| 5,186,697 | 2/1993 | Rennex . | |
| 5,242,343 | 9/1993 | Miller . | |
| 5,290,211 | 3/1994 | Stearns . | |
| 5,295,928 | 3/1994 | Rennex . | |
| 5,299,993 | 4/1994 | Habing . | |
| 5,383,829 | 1/1995 | Miller . | |
| 5,401,226 | 3/1995 | Stearns . | |
| 5,423,729 | 6/1995 | Eschenbach . | |
| 5,540,637 | 7/1996 | Rodgers | 482/52 |

FOREIGN PATENT DOCUMENTS

| | | |
|---|---|---|
| 2919494 | 5/1979 | Germany . |

*Primary Examiner*—Stephen R. Crow

*Attorney, Agent, or Firm*—Pravel, Hewitt, Kimball & Krieger

[57] ABSTRACT

A stationary recumbent exercising apparatus which promotes cardiovascular exercise yet minimizes impact to critical joints. A base frame supports a chair adapted to place the user in a recumbent position. The frame also supports a pair of reciprocating members supported within. The foot of the user is positioned on foot pads generally at one end of the reciprocating members. The pivotal linkage assemblies also include arm members which are operatively associated with the reciprocating movement of the foot portion of each reciprocating member. This provides for more natural movement of the ankle, knees and hips eliminating unnecessary stress on these joints yet permitting a cardiovascular workout. The arm members also provide for a corresponding upper body exercise.

27 Claims, 5 Drawing Sheets

FIG. 3
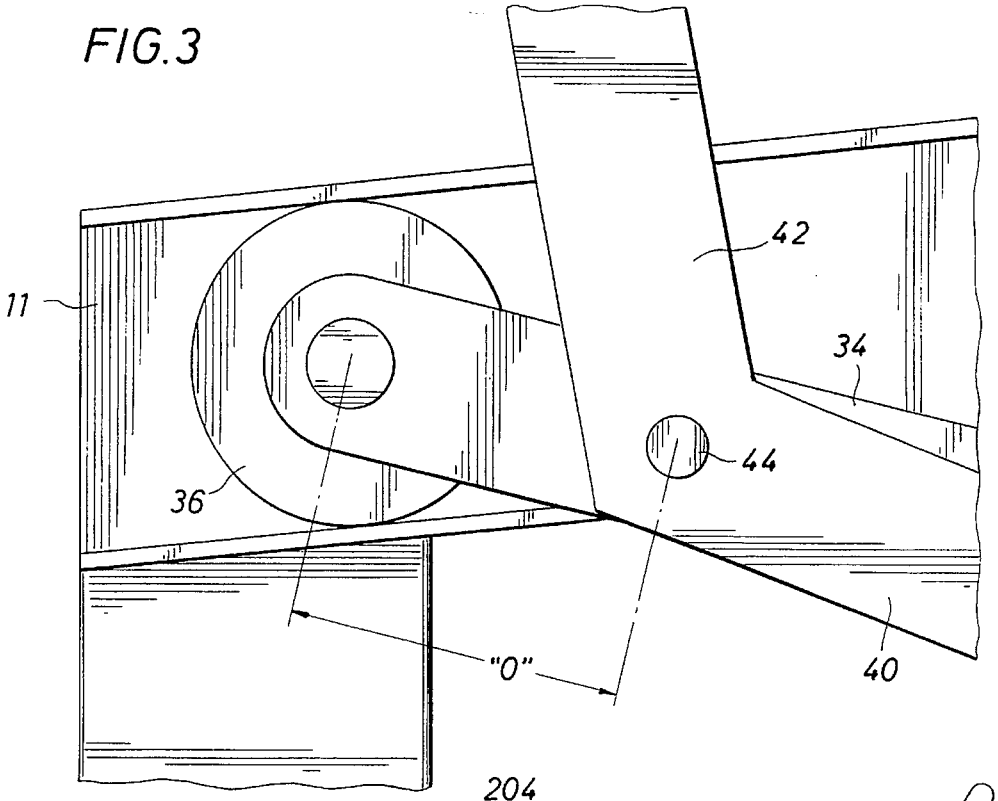
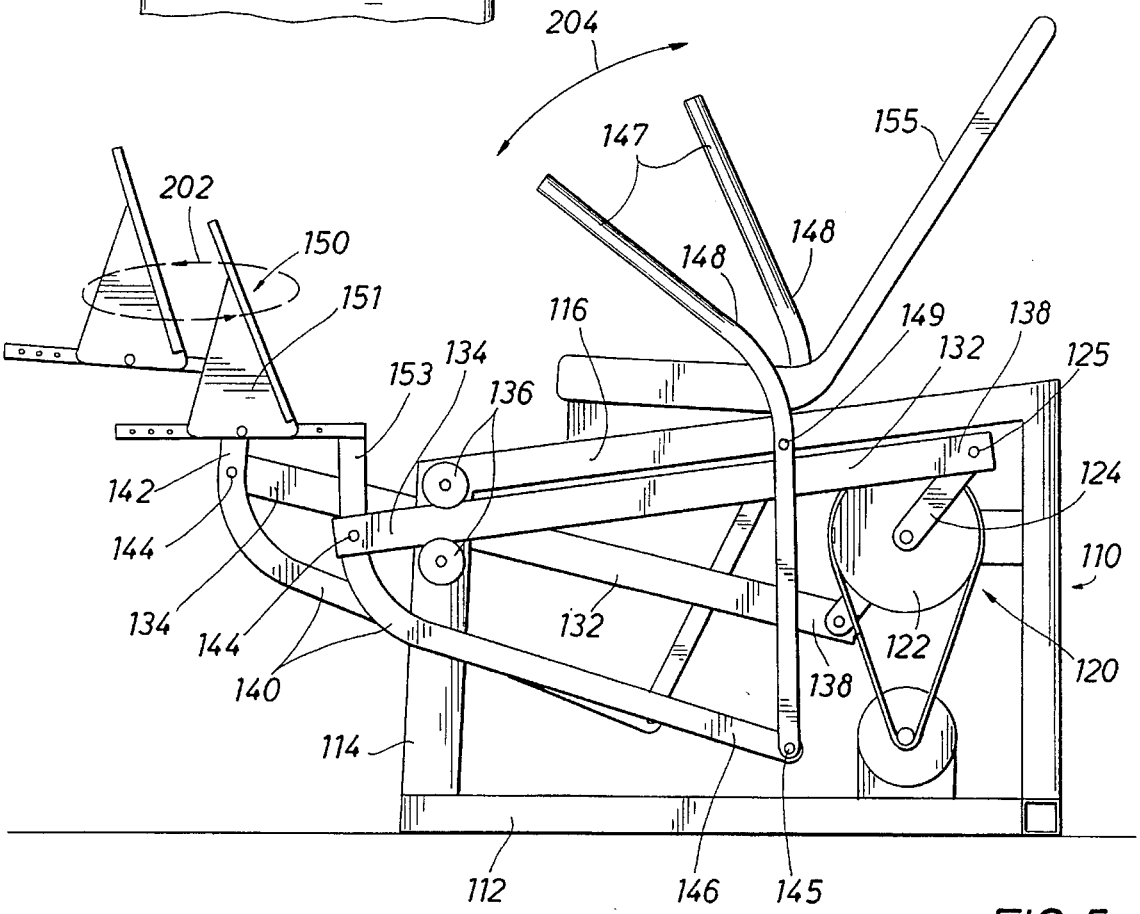
FIG. 5

RECUMBENT EXERCISE APPARATUS

BACKGROUND OF THE INVENTION

1. Field of the Invention

The present invention relates to a recumbent exercising apparatus. More particular, the invention relates to an improved recumbent exercising apparatus which enables the user to move his feet in a closed ovate path and his arms in a substantially arcuate path providing a safe, comfortable total body exercise.

2. Description of the Prior Art

Stair climbing is a popular form of exercise for the cardiovascular system. However, it can over prolonged use overstress the knees, ankles, hips and lower back. Walking is also a popular form of exercise but it does not load the cardiovascular system to the extent stair climbing does. Therefore, the need exists for an improved exercising device, preferably recumbent, which will load the cardiovascular system as stair climbing does but does not overload or unduly stress the ankles, knees, hips and other joints. Prior art stair climbing devices have common draw backs. Typically, they require excessive lifting of the knees or an exaggerated vertical movement of the lower legs. See, for example, U.S. Pat. Nos. 3,316,898; 3,759,511; 4,949,954; 4,949,993; 4,989,857; 5,135,477. Further, these prior art stair climbing and recumbent devices do not promote a natural movement of the ankles, knee and hip joints.

In addition, the need exists for a more rhythmic movement of the hand motions to accelerate a cardiovascular workout and exercise the upper body muscle groups without unduly overstressing the elbows and shoulders. Hence, the need exists for an improved recumbent exercise device which can combine the movements of the feet and hands in a more natural and rhythmic motion.

SUMMARY OF THE INVENTION

Briefly, the invention relates to an improved recumbent exercising device. A frame is provided which includes a base portion adapted to be supported by the floor. A seat is supported by the frame and provides support the user in a recumbent position. A coupling member is attached to the frame which includes a pulley defining a pivot axis. Two reciprocating members are positioned in spaced relationship to the base portion of the frame. One end of each reciprocating member is adapted for substantially linear or reciprocating motion. The other end of each reciprocating member is attached, directly or indirectly, to the pulley of the coupling member. In this manner, rotation of the pulley rotates one end of each reciprocating member in a circular motion while a portion of the other end of each reciprocating member moves in the substantially linear manner. First and second pivotal linkage assemblies are also included which are operatively associated with the reciprocating members for orienting the bottom of each foot of the user so that each foot follows a closed ovate path during the operation of the apparatus.

Each such pivotal linkage assembly includes a first link and a second link. The first link is pivotally connected proximal one end between the two ends of a reciprocating member. The other end of the first link is pivotally connected to one end of the second link. The second link is then pivotally restrained proximate the top portion of the frame adjacent the seat. Each second link also includes a handle portion providing for hand movement of the user in an arcuate path.

The more important features of this invention have been summarized rather broadly in order that the detailed description may be better understood. There are, of course, additional features of the invention which will be described hereafter and which will also form the subject of the claims appended hereto.

BRIEF DESCRIPTION OF THE DRAWINGS

In order to more fully describe the drawings used in the detailed description of the present invention, a brief description of each drawing is provided.

FIG. 3 is a detailed elevation view of a portion of the present invention.

FIG. 5 is an elevation view of an alternate embodiment of the present invention.

Figure 8:
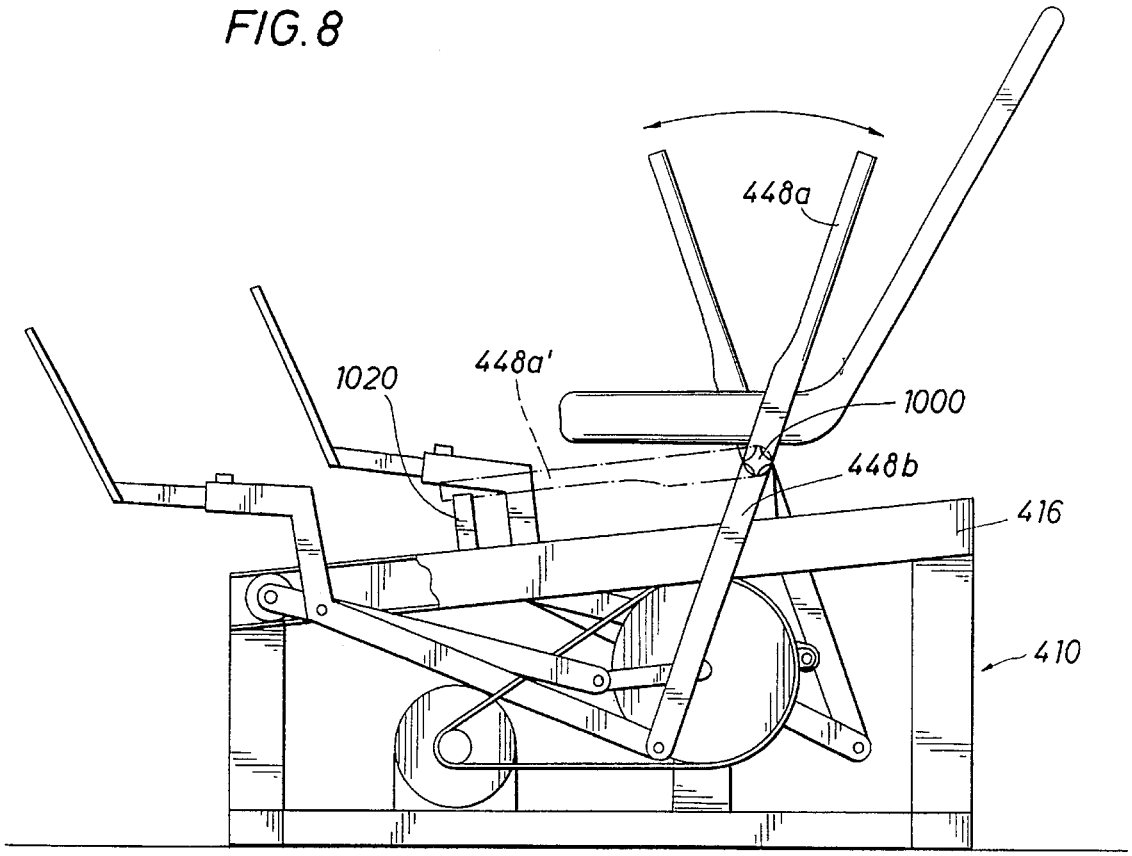
FIG. 8 is an elevation view of yet a further alternate embodiment of the present invention.

FIGS. *9a–9c* are detailed views of a portion of the alternate embodiment of the present invention shown in FIG. 8.

DETAILED DESCRIPTION OF PRESENT INVENTION

Figure 1:
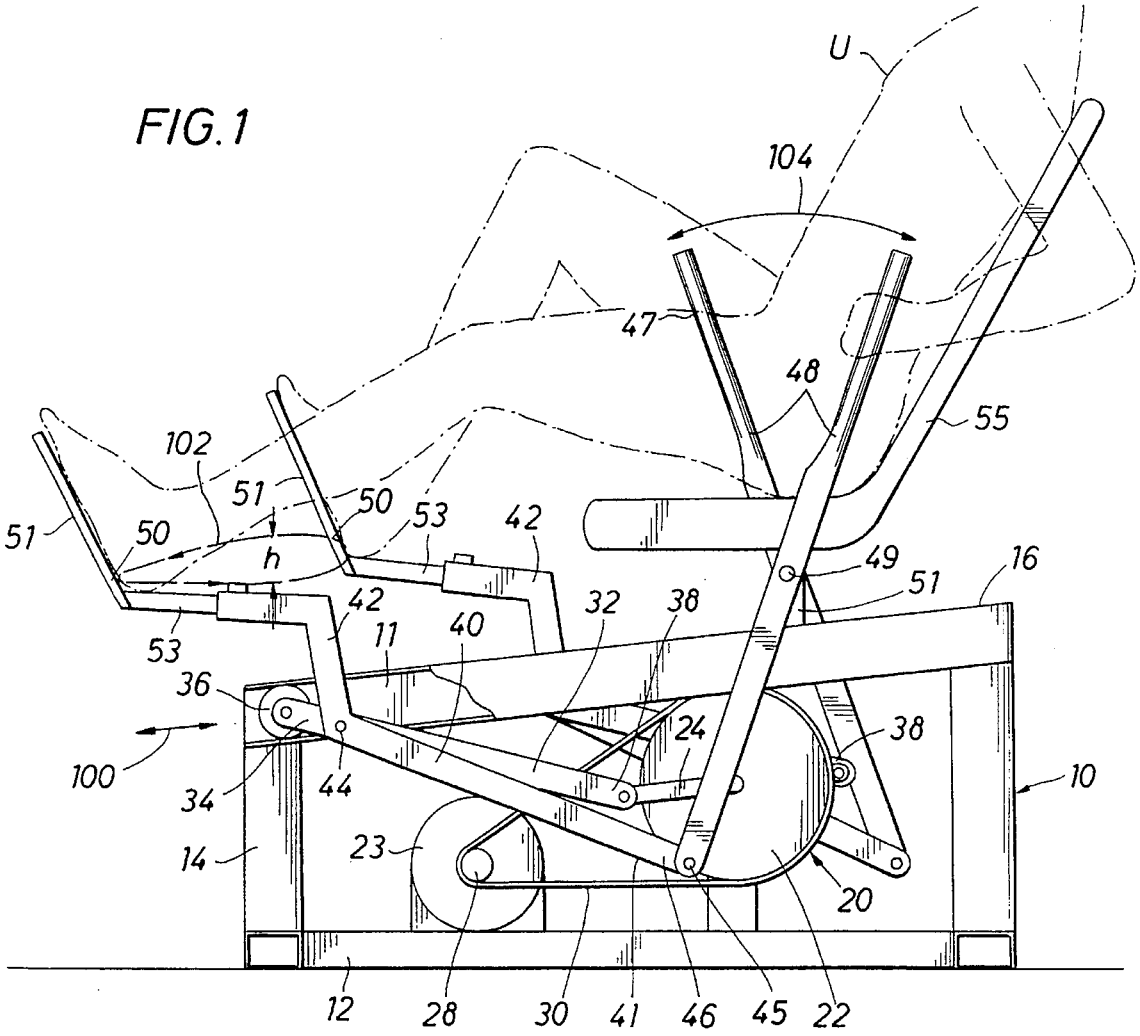
FIG. 1 is an elevation view of the preferred embodiment of the present invention.
Figure 2:
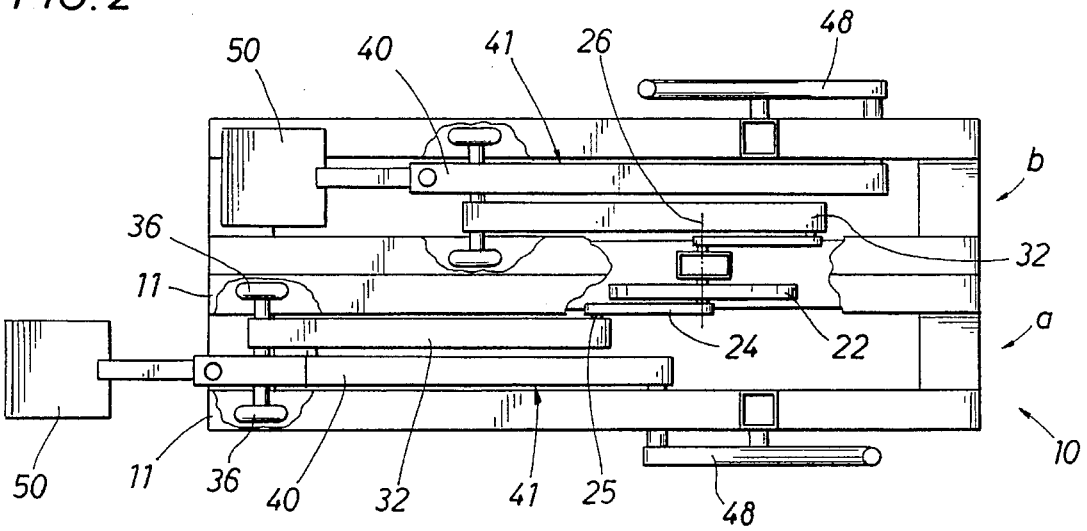
FIG. 2 is a plan view of the preferred embodiment of the present invention.

Referring to FIGS. 1 and 2, a frame 10 is shown comprising a base portion 12, a mid portion 14, and a top portion 16. Referring briefly to FIG. 2, it can be seen that frame 10 is, in essence, comprised of two separate longitudinal bents "a" and "b".

A coupling system 20 is fixed relative to frame 10 and comprises a pulley 22, crank members 24, resistant brake 23, sheave 28 and belt 30. Two reciprocating members 32 are positioned within frame 10. Each reciprocating member 32 has one end 34 which is adapted to move in a substantially linear or reciprocating direction within a member 11 of frame 10 as shown by arrow 100 in FIG. 1. Rollers 36 are mounted at each end 34 of reciprocating member 32 and, as shown in FIGS. 1 and 2, are adapted to ride within top members 11 of frame 10. The other end 38 of each reciprocating member 32 is pivotally connected at one end to a crank 24. The pivotal connection at end 38 may be through a pivotal connection member 25 (see FIG. 2) which extends between the end 38 of a reciprocating member 32 and a crank 24. The other end of each crank 24 is attached to pulley 22 at pivot axis 26 with the coupling system 20. Pivot axis 26 is the axis about which pulley 22 rotates.

In the preferred embodiment, the present invention also includes a pair of pivotable linkage assemblies 41. Each linkage assembly 41 includes a foot member, or contact member, 40 and an arm member 48. Each foot member 40 is pivotally attached proximate a first end 42 through a pin connection 44 to one reciprocating arm 32. A foot pad 50 is shown comprising an inclined rest plate 51 and an insert member 53. Each insert member 53 is adapted to fit within the first end 42 of a foot member 40. For purposes of the present invention, each foot member 40 is understood to include a foot pad 50 with associated inclined rest plate 51 and insert member 53.

Each foot member 40 is pivotally attached at its other end 46 through pin connection 45 to an arm member 48. Each arm member 48 is also pivotally attached at connection 49 to a support plate 51 which is in turn attached to top portion 16 of frame 10. A handle portion 47 is included as a part of the top end of each arm member 48. In addition, a seat 55 is also supported by members 51 preferably. Referring to FIG. 2, it can be seen that arm members 48 will straddle each side of seat 55.

Referring briefly to FIG. 2, it can be seen that the frame 10 comprises dual longitudinal bents "a" and "b". Furthermore, it can be seen that reciprocating members 32, foot members 40 and arm members 48 provide identical dual systems; each system resting on a base portion of the frame and each arranged to accommodate one foot and one arm of the user. Obviously, variations can be made to frame 10 as disclosed without departing from the spirit of the invention.

In the operation of the preferred embodiment, the user "U" sits on seat 55 and rests one foot against each inclined rest plate 51. The user begins a peddling motion accompanied with an oscillating motion of handles 47. Thus, during operation, a circular motion occurs at the second end 38 of each reciprocating member 32. However, at points between the opposite ends 34 and 38 of each reciprocating member 32, the motion gradually changes from a circular motion (at ends 38) to a substantially linear motion at ends 34. This geometric transition occurs in the form of a closed ovate path 102. Ovate path 102 is a more natural and rythmitic body movement. In addition, an arcuate motion, as shown by arrow 104, of the handles 47 provide cardiovascular workout of the upper body portion.

Referring now to FIG. 3, roller 36 is positioned within member 11 of frame 10. Also shown is the pivot connection 44 between reciprocating member 32 and foot member 40. An offset distance "O" is noted which is the distance between the axis of roller 36 and pivotal connection 44. The height "h" (see FIG. 1) of ovate path 102 can be adjusted by modifying offset distance "O". The larger the offset distance "O", the larger the height "h" of ovate path 102.

If the offset distance "O" is reduced to zero (that is, the foot member 40 is pivotally connected to end 34 of reciprocating member 32 at roller 36), then the height of ovate path 102 is zero and each rest plate 51 simply reciprocates along a curved path similar to a top half of ovate path 102. When the offset distance "O" is positive (as that shown in FIG. 3) and one foot is extended to its furtherest forward position (as shown by the left foot of the user in FIG. 1), then the other (or right) foot of the user will moved up and forward in a counterclockwise position. If the offset distance "O" is negative (that is, foot member 40 is pivotally connected to an extension of the reciprocating member to the left of roller 36), then the right foot of the user will move down and forward in a clockwise position when the left foot of the user is fully extended.

Figure 4:
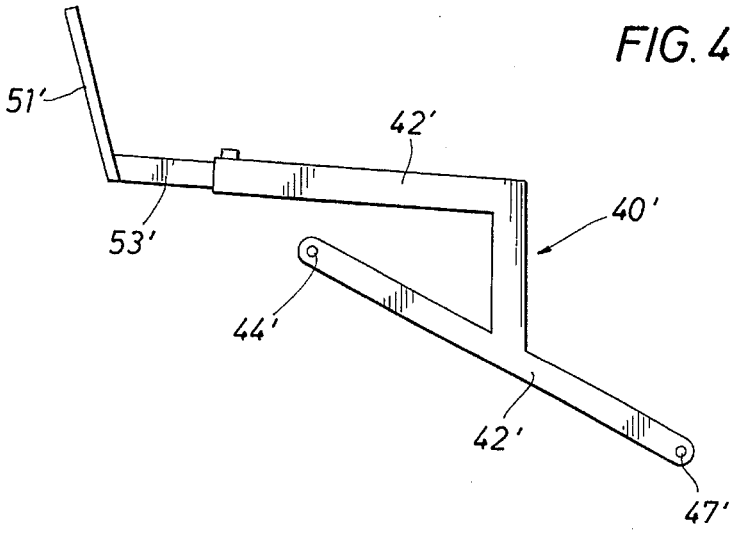
FIG. 4 is an isolated detailed view of an alternate embodiment of the first link of the pivotal linkage assemblies of the present invention.

Referring now to FIG. 4, it will be apparent to one skilled in the art based on this disclosure that each foot contact member 40 can assume a number of shapes but perform the same function as shown in FIG. 1 of the preferred embodiment. For example, the shape shown in FIG. 4 performs the same function as member 40 of FIG. 1 but may be used to distance the first portion 42' from the other portion 42" of member 40' enabling the installation of a housing (not shown) to hide the mechanism of the present invention during the operation of the device.

Referring now to FIG. 5, an alternate embodiment of the present invention is shown. Identical two-digit reference numerals will be used to designate similar structure found in the preferred embodiment but with a 100 series prefix. Frame 110 comprises a lower base portion 112, a mid portion 114 and a top portion 116. A coupling system 120 is included having identical components of the coupling system 20 described above for the preferred embodiment. Furthermore, coupling system 120 performs in an identical manner to coupling system 20 described above for the preferred embodiment.

A pair of reciprocating members 132 are also included, each having a first end 134 and a second end 138. The second end 138 of each reciprocating member 132 is pivotally connected via a pinned connection or pin member 125 to one end of each crank 124. Again, two foot members 140 are included, each one being pivotally connected proximate a first end 142 via a pin connection 144 to a corresponding reciprocating member 132. Each foot member 140 also includes a foot pad 150 having an inclined rest plate 151 supported by an insert member 153.

A seat 155 is also supported proximate top portion 116 of frame 110. Seat 155 is fixed relative to frame 110. Referring still to FIG. 5, the forward portion of each reciprocating member 132 is vertically restrained by rollers 136 which are now affixed to frame 110.

As in the case of the preferred embodiment this alternate embodiment also includes arm members 148 which are each pivotally connected at connection 145 to one end 146 of a foot member 140. Each arm member 148 is pivotally attached proximate its other end to frame 110 at connection 149. Further, each arm member 148 includes a handle portion 147.

As in the case of the preferred embodiment, in the operation of this alternate embodiment the user sits on seat 155, places one foot on each plate 151, grabs a handle 147 and begins a reciprocating motion with each leg. As such, each end 138 of reciprocating member 132 moves in a circular path about pulley 122 while the other end 134 of each reciprocating member serves to raise and lower corresponding foot pad 150 in a closed ovate path 202. Additionally, each handle 147 is moved in an arcuate path as shown by arrow 204.

Figure 6:
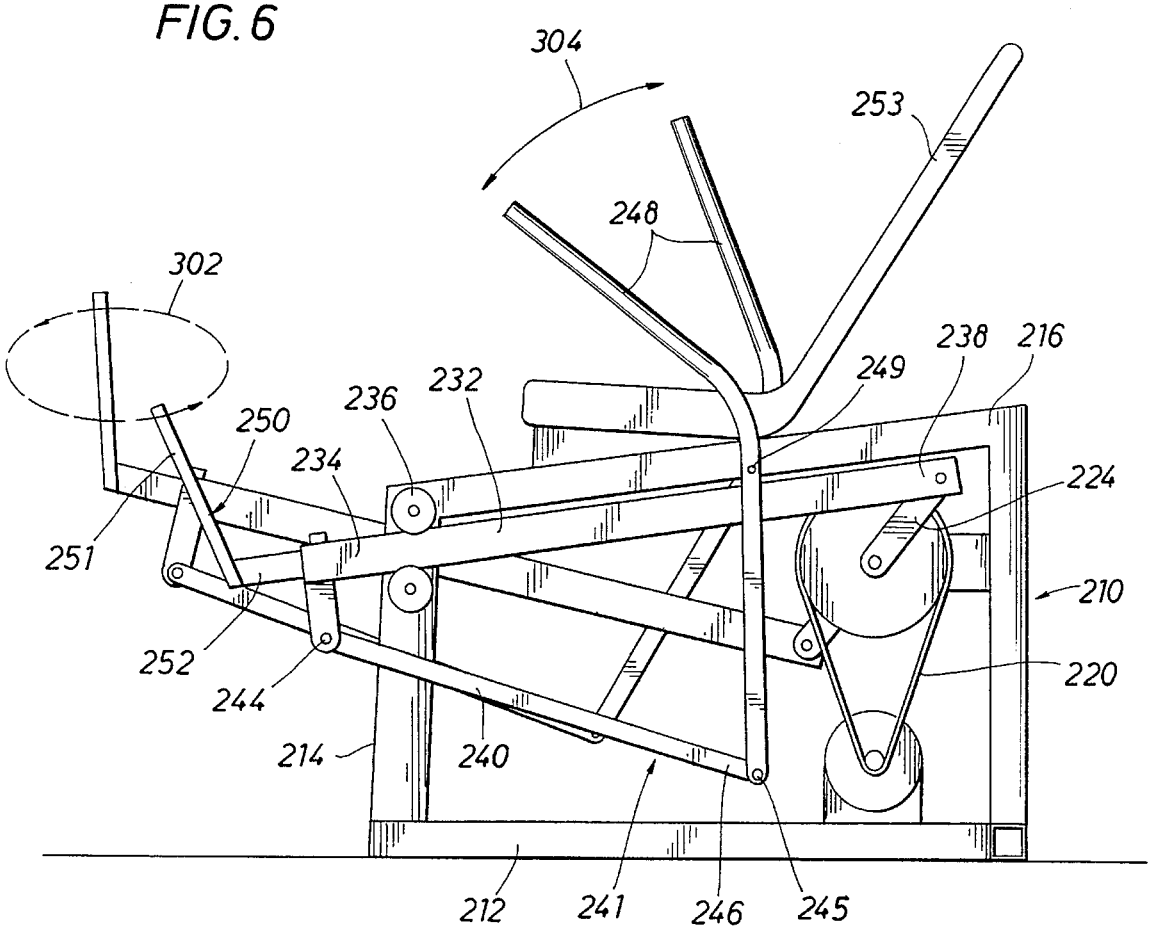
FIG. 6 is an elevation view of another alternate embodiment of the present invention.

Referring now to FIG. 6, another alternate embodiment of the present invention is shown. As before, similar parts will be designated by the same two-digit reference numeral as shown in the preferred embodiment but now with a 200 series prefix. Frame 210 again comprises a base portion 212, a mid portion 214 and a top portion 216. A coupler system 220 is also provided which is identical in structure and function to coupling system 20 of the preferred embodiment (FIGS. 1–2). This alternate embodiment also includes a pair of reciprocating members 232, each having a first end 234 which is generally laterally restrained by rollers 236 fixedly mounted to frame 210. Similarly, each reciprocating member 232 includes a second end 238 pivotally attached to one end of a crank 224. In this alternate embodiment, a first and second pivot linkage assemblies 241 are also provided. Each pivot linkage assembly 241 includes a foot pad 250 operatively associated with a corresponding foot member 240. In this particular embodiment, foot pad 250 includes an inclined rest plate 251 and an insert member 252 which is adjusted relative to reciprocating member 232 for optimum user comfort. Corresponding foot member 240 is also pivotally fixed to a reciprocating member 232 via a pivotal linkage point 244. Arm members 248 are also included, each arm member being pivotally attached at one connection 245 to one end 246 of a foot contact member 240 and pivotally connected at connection 249 to frame 210.

Once again, in the operation of this alternate embodiment the user rests on a seat 253 which is fixedly attached to frame 210 and begins a reciprocating leg motion. This results in the transition of each foot of the user through a generally closed ovate path 302 while the hand motion transverses through an arcuate path 304.

As in the previous embodiments, this results in a smooth motion of each foot of the user and corresponding exercising of certain muscle groups in the upper body through movement of the arms along the arcuate path 304.

Figure 7:
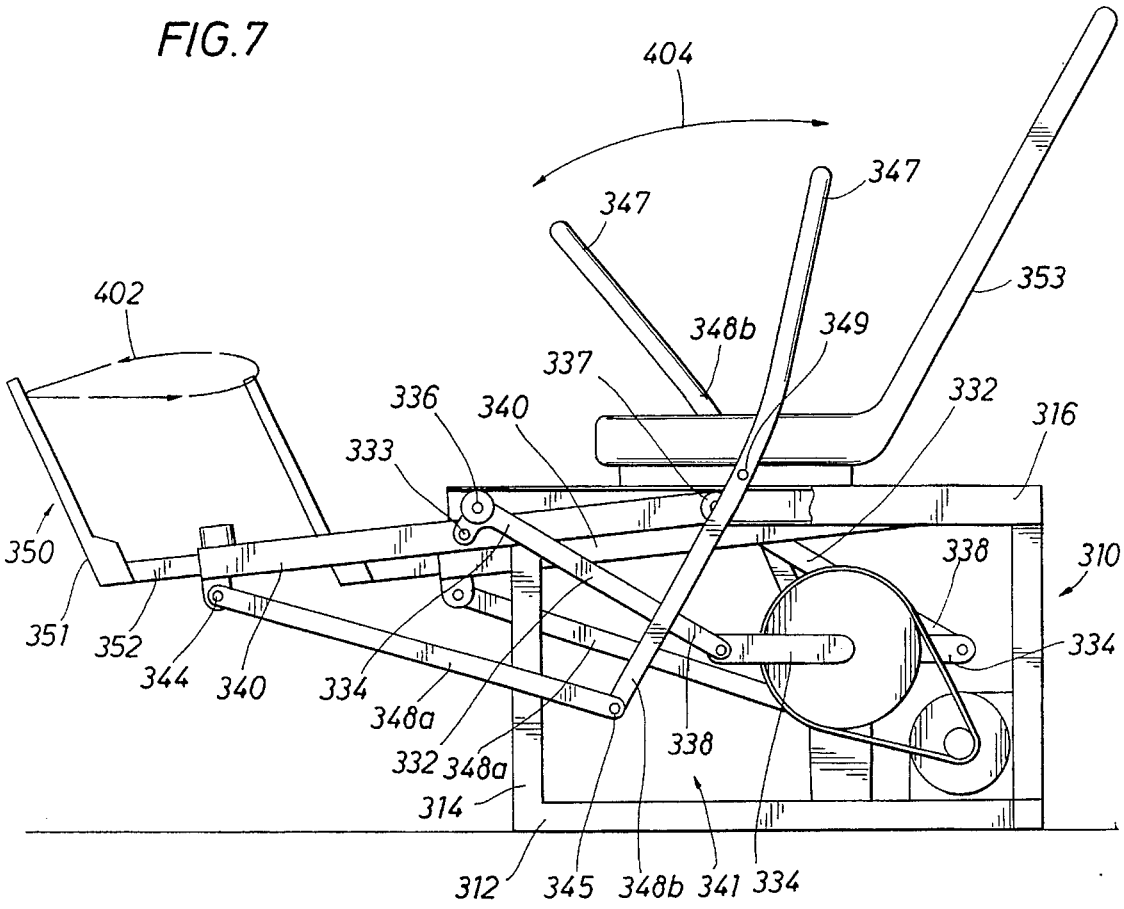
FIG. 7 is an elevation view of yet another alternate embodiment of the present invention.
Figure 9A:
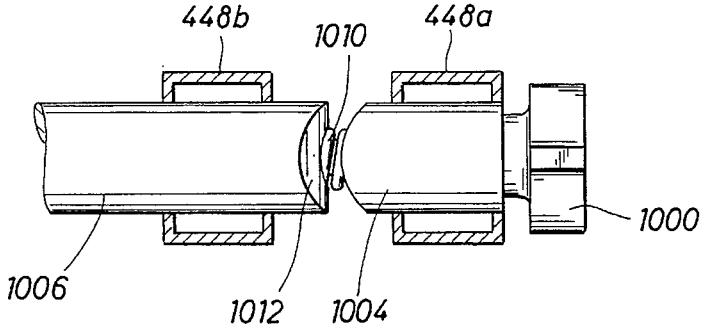

Referring now to FIG. 7, yet another alternate embodiment of the present invention is shown. As before, similar parts will be designated by the same two-digit reference numeral as shown in the preferred embodiment but now with a 300 series prefix. Frame 310 again comprises a base portion 312, a mid portion 314 and a top portion 316. A coupling system 320 is also provided which is identical in structure and function to coupling system 20 of the preferred embodiment (FIGS. 1–2). This alternate embodiment also includes a pair of reciprocating members 332, each having a first end 334 which is generally vertically restrained by a roller 336 that engages top portion 316 of frame 310. Each reciprocating member 332 also includes a second end 338 pivotally attached to one end of a crank 334. Crank 334 is in turn part of coupling system 320 as discussed above with respect to the preferred embodiment.

In this alternate embodiment first and second pivot linkage assemblies 341 are also provided. Each pivot linkage assembly 341 includes a foot member 340, a foot pad 350 and pivotable arm members **348*a* and 348*b* . Foot pad 350 includes an inclined rest plate 351 and an insert member 352 which is adjusted relative to a foot member 340 for optimum user comfort. Referring still to FIG. 7, end 334 is shown having a 90° bent enabling a pivotal connection at pin 333 to a foot member 340. The other end of each foot member 340 is supported in a vertical direction by roller 337 which also slides within top portion 316 of frame 310. In this manner, top portion 316 serves as a track to guide rollers 336 and 337**.

Referring now to the arm members, one end of each arm member **348*a* and 348*b* are pivotally connected at pin connection 345. The other end of arm member 348*b* is pivotally connected at pin 349 to frame 310. Similarly, the other end of arm member 348*a* is pivotally connected at pin 344 to a foot member 340**.

As in the case of the previous embodiments, the user rests on a seat 353 and begins a reciprocating leg motion. This results in the translation of each foot of the user through a generally closed ovate path 402 while the hand motion transverses through an arcuate path 404.

Referring now to FIGS. 8 and **9*a*–9*c*, an alternate detail is shown which may be included in any of the alternate versions previously described. As before, similar parts will be designated by the same two-digit reference numeral as shown in the preferred embodiment but now with a 400 series prefix. Each arm member comprises two portions, 448*a* and 448*b*. A knob 1000 is used to anchor top arm portion 448*a* to lower arm portion 448*b*** if the user wishes to employ the arm members to perform upper body exercise.

Figure 9B:
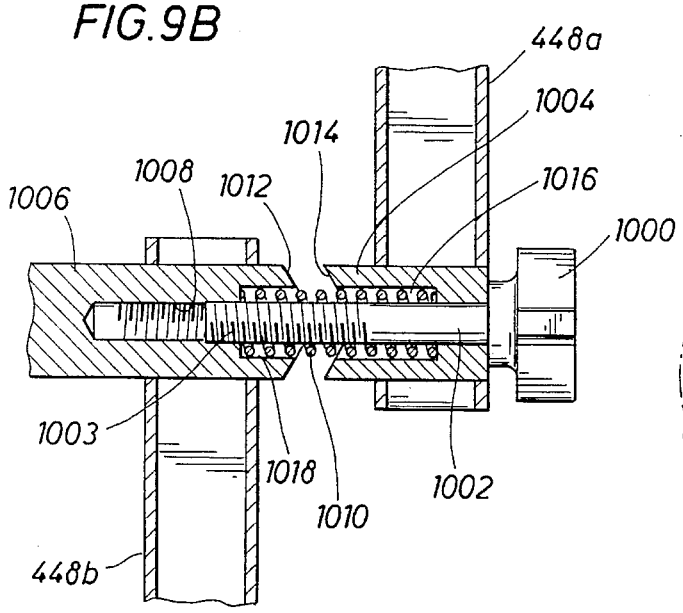
Figure 9C:
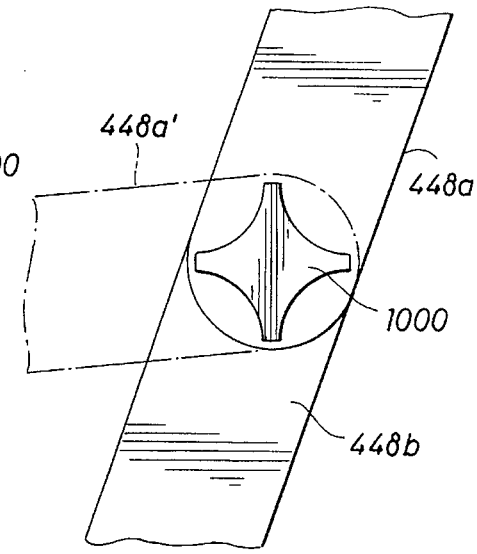

Referring to FIGS. **9*a*–9*c*, knob 1000 is connected to a shaft 1002 which is adapted to be inserted within bearing 1004 of arm member 448*a* and bearing 1006 of arm member 448*b*. Shaft 1002 includes a threaded portion 1003 adapted to engage corresponding threads 1008 within bearing 1006. A spring 1010 circumscribes shaft 1002 and seats within recess portion 1016 of bearing 1004 and recess portion 1018 of bearing 1006. Additionally, bearing 1004 includes a bevelled surface 1014 adapted to engage and mate with bevelled surface 1012 of bearing 1006. In this manner, the user may rotate knob 1000, rotating shaft 1002 within bearing 106 thereby compressing spring 1010 which causes the engagement of bevelled surfaces 1012 and 1014. In this manner, top arm member 448*a* is locked in a vertical position relative to arm member 448*b* as shown in solid lines in FIGS. 8 and 9*c* . Alternatively, if the user does not wish to exercise upper body muscles or finds the oscillating movement of upper arm members 448*a* undesirable, knob 1000 of each arm member 448*a*/448*b* may be rotated in a counterclockwise rotation. This causes the separation of bevelled surfaces 1014 and 1012 as a result of the compressive force of spring 1010. Once adequate clearance of bevelled surfaces 1012 and 1014 is achieved, the user may rotate arm member 448*a* to a horizontal position as shown by phantom lines 448*a*' in FIGS. 8 and 9*c*. The top portion of arm member 448*a*' may rest against support 1020 which is attached to the top portion 416 of frame 410**.

An improved recumbent exercising apparatus is disclosed in the foregoing preferred and alternate embodiments which maximizes cardiovascular exercise yet minimizes stress on critical joints. Obviously, modifications and alterations to the embodiments disclosed herein will be apparent to those skilled in the art in view of this disclosure. However, it is intended that all such variations and modifications fall within the spirit and scope of the invention as claimed.

What is claimed is:

1. An apparatus for exercising in a recumbent position comprising:

a frame having a base portion adapted to be supported by a floor;

a seat attached to said frame and adapted to support the user in the recumbent position;

first and second reciprocating members, each reciprocating member having a first end and a second end, a portion of said first and second reciprocating members adapted for substantially linear motion;

a coupling member having (i) a pulley supported by said frame defining a pivot axis, and (ii) means for attaching said second ends of said first and second reciprocating members to said pulley so that rotation of said pulley results in the rotation of said second ends of said first and second reciprocating members in a substantially circular path about said pivot axis while a portion of each of said first and second reciprocating members distal said second end of each said first and second reciprocating member moves in a reciprocating pattern; and first and second pivotal linkage assemblies operatively associated with said reciprocating members for orienting the feet of the user of the apparatus so that each foot of the user follows a closed ovate path during operation of the apparatus.

2. The exercising apparatus according to claim 1 wherein said frame further includes track means to support said first ends of said reciprocating members during said substantially linear motion.

3. The exercising apparatus according to claim 2 wherein track means are inclined relative to the floor.

4. The exercise apparatus according to claim 1 wherein said coupling member attaching means comprises:

a first element attached at one end to said pulley proximate said pivot axis and at its other end to said second end of said first reciprocating member; and a second element attached at one end to said pulley proximate said pivot axis and at its other end to said second end of said second reciprocating member.

5. The exercising apparatus according to claim 1 wherein:

said first pivotal linkage assembly being pivotally connected proximate one end between the first and second ends of said first reciprocating member proximate said first end of said first reciprocating member, and said second pivotal linkage assembly being pivotally connected proximate one end between the first and second ends of said second reciprocating member proximate said first end of said second reciprocating member, each linkage assembly being pivotally attached at its other end to said frame distally from said coupling member, and said first and second linkage assemblies having a handle portion proximate said pivotal connection to said frame so that the user of said apparatus may grip the handle portions during use of the apparatus enabling a substantially arcuate movement of said handle portions.

6. The exercising apparatus according to claim 5 further comprising means for disengaging said handle portions.

7. The exercising apparatus according to claim 1 wherein:

said first pivotal linkage assembly comprises a first link and a second link, one end of said first link of said first linkage assembly being pivotally attached proximate said one end between said first and second ends of said first reciprocating member, and said second link of said first linkage assembly being pivotally connected at one end to the other end of said first link and pivotally-connected proximate the other end of said second link to said frame;

a second linkage assembly comprising a first link and a second link, one end of said first link of said second linkage assembly being pivotally attached proximate said one end of said first link of said second linkage assembly between said first and second ends of said second reciprocating member, and said second link of said second linkage assembly being pivotally connected at one end to the other end of said first link of said second linkage assembly and pivotally connected proximate the other end of said second link to said frame;

said second links of said first linkage assembly and said second linkage assembly having a handle portion proximate said other end so that the user may grip the handle portions during use of the apparatus enabling a substantially arcuate movement of said handle portions.

8. A recumbent exercising apparatus comprising:

a frame having a base portion adapted to be supported by a floor and a seat adapted to support the user in the recumbent position;

a first linkage assembly having:

(i) a first reciprocating member, (ii) a first foot member, and (iii) a first arm member, said first reciprocating member having a first end and a second end;

a second linkage assembly having:

(i) a second reciprocating member, (ii) a second foot member, and (iii) a second arm member, said second reciprocating member having a first end and a second end; and a coupling member having:

(i) a pulley supported by said frame defining a pivot axis; and (ii) means for attaching said second ends of said first and second reciprocating members to said pulley so that rotation of said pulley results in the rotation of said second ends of said reciprocating members in a substantially circular path about said axis while a portion of each of said first and second reciprocating members distal said second end of each said first and second reciprocating member moves in a reciprocating pattern;

said first foot member being pivotally connected proximal one end between said first and second ends of said first reciprocating member, and the other end of said first foot member being pivotally connected to one end of said first arm member, said first arm member being pivotally connected distally from said one end of said first arm member to said frame, said first arm member having a handle portion distally from said pivotal connection to said first foot member;

said second foot member being pivotally connected proximal one end between said first and second ends of said second reciprocating member, and the other end of said second foot member being pivotally connected to one end of said second arm member, said second arm member being pivotally connected distally from said one end of said second arm member to said frame, said second arm member having a handle portion distally from said pivotal connection to said second foot member, wherein each foot of the user follows a closed ovate path and each hand of the user follows a substantially arcuate path.

9. The exercising apparatus according to claim 8 wherein said frame further includes track means to support said first ends of said reciprocating members during said reciprocating pattern.

10. The exercising apparatus according to claim 9 wherein track means are inclined relative to the floor.

11. The exercising apparatus according to claim 8 wherein said coupling member attaching means comprises:

a first element attached at one end to said pulley proximate said pivot axis and at its other end to said second end of said first reciprocating member; and a second element attached at one end to said pulley proximate said pivot axis and at its other end to said second end of said second reciprocating member.

12. An apparatus for exercising in a recumbent position comprising:

a frame having a base portion adapted to be supported by a floor;

a seat attached to said frame and adapted to support the user in the recumbent position;

first and second reciprocating members, each reciprocating member having a first end and a second end, a portion of said first and second reciprocating members adapted for substantially linear motion;

coupling means for rotating the second ends of said first and second reciprocating members in a substantially circular path about a common pivot axis while a portion of each of said first and second reciprocating members distal said second end of each said first and second reciprocating member moves in a reciprocating pattern; and first and second pivotal linkage assemblies operatively associated with said reciprocating members for orienting the feet and the hands of the user of the apparatus so that each foot of the user follows a closed ovate path during operation of the apparatus while each hand of the user follows a substantially arcuate path.

13. A recumbent exercising apparatus comprising:

a frame having a base portion adapted to be supported by a floor and a seat adapted to support the user in the recumbent position;

first and second reciprocating members, each reciprocating member having a first end and a second end;

coupling means for rotating the second ends of said first and second reciprocating members in a substantially circular path about a common axis while a portion of each of said first and second reciprocating members distal said second end of each said first and second reciprocating member moves in a reciprocating pattern;

first linkage assembly having a foot member and an arm member, said foot member of said first linkage assembly pivotally connected to said first reciprocating member proximate said first end of said first reciprocating member, said pivotal connection being proximal a first end of said foot member, and said foot member pivotally connected at its other end to one end of said arm member, said arm member pivotally connected to said frame proximal the other end of said arm member; and second linkage assembly having a foot member and an arm member, said foot member of said second linkage assembly pivotally connected to said second reciprocating member proximate said first end of said second reciprocating member, said pivotal connection being proximal a first end of said foot member of said second linkage assembly, and said foot member of said second linkage assembly pivotally connected at its other end to one end of said arm member of said second linkage assembly, said arm member of said second linkage assembly pivotally connected to said frame proximal to the other end of said arm member of said second linkage assembly, wherein each foot of the user of the device follows a closed ovate path and each hand of the user follows a substantially arcuate path.

14. The exercising apparatus according to claim 13 wherein said frame further includes track means to support said first ends of said reciprocating members during said reciprocating pattern.

15. The exercising apparatus according to claim 14 wherein track means are inclined relative to the floor.

16. The exercising apparatus according to claim 13 further comprising means for disengaging at least a portion of said arm members eliminating the arcuate path motion.

17. The exercising device according to claim 13 wherein said coupling member attaching means comprises:

a first element attached at one end to said pulley proximate said pivot axis and at its other end to said second end of said first reciprocating member; and a second element attached at one end to said pulley proximate said pivot axis and at its other end to said second end of said second reciprocating member.

18. An apparatus for exercising in a recumbent position comprising:

a frame having a base portion adapted to be supported by a floor;

a seat attached to said frame and adapted to support the user in a recumbent position;

first and second reciprocating members, each reciprocating member having a first end and a second end;

a coupling member having (i) a pulley supported by said frame defining a pivot axis, and (ii) means for attaching said second ends of said first and second reciprocating members to said pulley so that rotation of said pulley results in the rotation of said second ends of said first and second reciprocating members in a substantially circular path about said pivot axis while a portion of each of said first and second reciprocating members distal said second end of each of said first and second reciprocating member moves in a reciprocating pattern;

first and second linkage assemblies, said first linkage assembly pivotally connected proximate one end to said first reciprocating member proximate said first end of said first reciprocating member and said first linkage assembly having a foot member and an arm member, said second linkage assembly pivotally connected proximate one end to said second reciprocating member proximate said first end of said second reciprocating member and said second linkage assembly having a foot member and an arm member, each linkage assembly being pivotally attached proximate its other end to said frame, wherein each foot of the user follows a closed ovate path and each hand of the user follows a substantially arcuate path.

19. The exercising apparatus according to claim 18 wherein said frame further includes track means to support said first ends of said reciprocating members during said reciprocating pattern.

20. The exercising apparatus according to claim 19 wherein track means are inclined relative to the floor.

21. The exercising apparatus according to claim 18 wherein said coupling member attaching means comprises:

a first element attached at one end to said pulley proximate said pivot axis and at its other end to said second end of said first reciprocating member; and a second element attached at one end to said pulley proximate said pivot axis and at its other end to said second end of said second reciprocating member.

22. The exercising apparatus according to claim 18 further comprising means for disengaging at least a portion of said arm members eliminating the arcuate path motion.

23. A recumbent exercising apparatus comprising:

a frame having a base portion adapted to be supported by a floor and a seat adapted to support the user in a recumbent position;

a first linkage assembly having a first reciprocating member and a first foot contact member, said first reciprocating member having a first end and a second end, said first end of said first reciprocating member being adapted for reciprocating movement, said first foot contact member pivotally attached to said first reciprocating member proximate said first end of said first reciprocating member;

a second linkage assembly having a second reciprocating member and a second foot contact member, said second reciprocating member having a first end and a second end, said first end of said second reciprocating member being adapted for reciprocating movement, said second foot contact member pivotally attached to said second reciprocating member proximate said first end of said second reciprocating member; and a coupling member having a pulley supported by said frame defining a pivot axis and means for attaching said second ends of said first and second reciprocating members to said pulley so that rotation of said pulley results in the rotation of the second ends of said reciprocating members in a substantially circular path about said axis and wherein each foot of the user of the device follows a closed ovate path.

24. The exercising apparatus according to claim 23 wherein said frame further includes track means to support said first ends of said reciprocating members during said reciprocating movement.

25. The exercising apparatus according to claim 24 wherein track means are inclined relative to the floor.

26. The exercising apparatus according to claim 23 wherein said coupling member attaching means comprises:

a first element attached at one end to said pulley proximate said pivot axis and at its other end to said second end of said first reciprocating member; and a second element attached at one end to said pulley proximate said pivot axis and at its other end to said second end of said second reciprocating member.

27. The exercising apparatus according to claim 23 further comprising means for rotatably attaching said first and second foot contact members to said frame facilitating the reciprocating movement of said foot contact members relative to said frame.

* * * * *